US006059035A

United States Patent [19]

Chatterji et al.

[11] Patent Number: 6,059,035

[45] Date of Patent: May 9, 2000

[54] SUBTERRANEAN ZONE SEALING METHODS AND COMPOSITIONS

[75] Inventors: Jiten Chatterji; David D. Onan; Bobby J. King, all of Duncan; Roger S. Cromwell, Walters, all of Okla.

[73] Assignee: Halliburton Energy Services, Inc., Duncan, Okla.

[21] Appl. No.: 09/119,110

[22] Filed: Jul. 20, 1998

[51] Int. Cl.[7] ..... E21B 33/13

[52] U.S. Cl. ..... 166/293; 166/295; 166/305.1; 405/270; 523/130

[58] Field of Search ..... 166/285, 292, 166/293, 294, 295, 305.1; 405/270; 523/130, 131

[56] References Cited

U.S. PATENT DOCUMENTS

| | | | |
|---|---|---|---|
| 2,815,079 | 12/1957 | Goins, Jr. et al. | 166/29 |
| 3,082,823 | 3/1963 | Hower | 166/29 |
| 3,208,525 | 9/1965 | Caldwell et al. | 166/33 |
| 3,310,111 | 3/1967 | Pavlich et al. | 166/33 |
| 3,416,604 | 12/1968 | Rensvold | 166/33 |
| 3,467,208 | 9/1969 | Kelly, Jr. | 175/72 |
| 3,612,181 | 10/1971 | Brooks, Jr. | 166/295 |
| 3,750,768 | 8/1973 | Suman, Jr. et al. | 175/72 |
| 3,782,466 | 1/1974 | Lawson et al. | 166/254 |
| 3,894,977 | 7/1975 | Brown et al. | 260/18 EP |
| 3,933,204 | 1/1976 | Knapp | 166/295 |
| 3,960,801 | 6/1976 | Cole et al. | 260/33.6 |
| 3,976,135 | 8/1976 | Anderson | 166/276 |
| 4,042,031 | 8/1977 | Knapp | 166/276 |
| 4,042,032 | 8/1977 | Anderson et al. | 166/276 |
| 4,072,194 | 2/1978 | Cole et al. | 166/295 |
| 4,101,474 | 7/1978 | Copeland et al. | 260/13 |
| 4,113,015 | 9/1978 | Meijs | 166/295 |
| 4,127,173 | 11/1978 | Watkins et al. | 166/276 |
| 4,189,002 | 2/1980 | Martin | 166/295 |
| 4,199,484 | 4/1980 | Murphey | 260/13 |
| 4,215,001 | 7/1980 | Elphingstone et al. | 252/8.55 C |
| 4,216,829 | 8/1980 | Murphey | 166/276 |
| 4,220,566 | 9/1980 | Constien | 260/13 |
| 4,272,384 | 6/1981 | Martin | 252/8.55 R |
| 4,336,842 | 6/1982 | Graham et al. | 166/276 |
| 4,339,000 | 7/1982 | Cronmiller | 166/295 |
| 4,368,136 | 1/1983 | Murphey | 252/316 |
| 4,483,888 | 11/1984 | Wu | 427/336 |
| 4,489,785 | 12/1984 | Cole | 166/295 |
| 4,532,052 | 7/1985 | Weaver et al. | 166/275 X |
| 4,558,075 | 12/1985 | Suss et al. | 523/216 |
| 4,620,993 | 11/1986 | Suss et al. | 427/407.1 |
| 4,665,988 | 5/1987 | Murphey et al. | 166/295 |
| 4,741,401 | 5/1988 | Walles et al. | 166/300 |
| 4,773,482 | 9/1988 | Allison | 166/270 |
| 4,785,884 | 11/1988 | Armbruster | 166/280 |
| 4,829,100 | 5/1989 | Murphey et al. | 523/131 |
| 4,921,047 | 5/1990 | Summers | 166/276 |
| 4,972,906 | 11/1990 | McDaniel | 166/276 |
| 5,090,478 | 2/1992 | Summers | 166/278 |
| 5,095,987 | 3/1992 | Weaver et al. | 166/276 |
| 5,107,928 | 4/1992 | Hilterhaus | 166/293 |
| 5,133,409 | 7/1992 | Bour et al. | 166/293 |
| 5,159,980 | 11/1992 | Onan et al. | 166/294 |
| 5,168,928 | 12/1992 | Terry et al. | 166/292 |
| 5,211,234 | 5/1993 | Floyd | 166/276 |
| 5,213,161 | 5/1993 | King et al. | 166/293 |
| 5,232,961 | 8/1993 | Murphey et al. | 523/414 |
| 5,293,938 | 3/1994 | Onan et al. | 166/293 |
| 5,314,023 | 5/1994 | Dartez | 166/295 |
| 5,325,723 | 7/1994 | Meadows | 73/794 |
| 5,335,726 | 8/1994 | Rodrigues | 166/295 |
| 5,337,824 | 8/1994 | Cowan | 166/293 |
| 5,358,044 | 10/1994 | Hale et al. | 166/293 |
| 5,358,051 | 10/1994 | Rodrigues | 166/295 |
| 5,361,841 | 11/1994 | Hale et al. | 166/293 |
| 5,361,842 | 11/1994 | Hale et al. | 166/293 |
| 5,363,918 | 11/1994 | Cowan et al. | 166/295 |
| 5,368,102 | 11/1994 | Dewprashad et al. | 166/276 |
| 5,373,901 | 12/1994 | Norman et al. | 166/300 |
| 5,377,757 | 1/1995 | Ng | 166/277 |
| 5,388,648 | 2/1995 | Jordan, Jr. | 166/380 |
| 5,428,178 | 6/1995 | Zuzich et al. | 549/378 |
| 5,458,195 | 10/1995 | Totten et al. | 166/293 |
| 5,547,027 | 8/1996 | Chan et al. | 166/295 |
| 5,559,086 | 9/1996 | Dewprashad et al. | 207/219 |
| 5,692,566 | 12/1997 | Surles | 166/295 |
| 5,696,006 | 12/1997 | Onan et al. | 523/166 |
| 5,873,413 | 2/1999 | Chatterji et al. | 166/293 |
| 5,875,844 | 3/1999 | Chatterji et al. | 166/293 |
| 5,875,845 | 3/1999 | Chatterji et al. | 166/293 |
| 5,875,846 | 3/1999 | Chatterji et al. | 166/293 |
| 5,911,282 | 6/1999 | Onan et al. | 175/75 |
| 5,913,364 | 6/1999 | Sweatman | 166/281 |
| 5,957,204 | 9/1999 | Chatterji et al. | 166/295 |
| 6,006,835 | 12/1999 | Onan et al. | 166/295 |
| 6,006,836 | 12/1999 | Chatterji et al. | 166/295 |

FOREIGN PATENT DOCUMENTS

| | | | |
|---|---|---|---|
| 0 553 566 A1 | 8/1993 | European Pat. Off. | C21B 43/04 |
| 0 802 253 A1 | 10/1997 | European Pat. Off. | C09K 7/02 |
| 1315462 | 12/1962 | France . | |
| 1019122 | 2/1966 | United Kingdom | E02D 3/14 |
| WO 91/02703 | 7/1991 | WIPO . | |
| WO 94/12445 | 9/1994 | WIPO . | |

*Primary Examiner*—Roger Schoeppel
*Attorney, Agent, or Firm*—Craig W. Roddy; C. Clark Dougherty, Jr.

[57] ABSTRACT

The present invention provides sealing methods and compositions for use in subterranean zones penetrated by well bores. The methods of the invention basically include the steps of preparing a sealing composition which includes an aqueous silicate solution, an epoxide containing liquid and a delayed epoxide hardening agent, placing the sealing composition into a subterranean zone and allowing the sealing composition to set into a rigid impermeable sealing mass in the zone.

20 Claims, No Drawings

SUBTERRANEAN ZONE SEALING METHODS AND COMPOSITIONS

BACKGROUND OF THE INVENTION

1. Field of the Invention

The present invention relates to improved methods and compositions for sealing subterranean zones penetrated by well bores.

2. Description of the Prior Art

In the drilling of oil and gas wells using the rotary drilling method, drilling fluid is circulated through the drill string and drill bit and then back to the surface by way of the well bore being drilled. The drilling fluid maintains hydrostatic pressure on the subterranean zones through which the well bore is drilled and circulates cuttings out of the well bore. During such drilling, subterranean vugs, fractures and other thief zones are often encountered whereby the drilling fluid circulation is lost and drilling operations must be terminated until remedial steps are taken. In addition to drilling fluid lost circulation zones, zones containing pressurized fluids can be encountered which cause undesirable gas, oil or water production into the well bore or cross-flows through the well bore.

Heretofore, sealing compositions comprised of sodium silicate solutions have been used to control lost circulation and terminate undesirable fluid production and cross-flows in subterranean zones. When such a sodium silicate sealing composition is placed in a subterranean zone, the sodium silicate solution is polymerized or cross-linked whereby a pliable gel is formed which functions to temporarily reduce or terminate lost circulation, undesirable fluid production or cross-flows. Thereafter, the zone has typically been cemented utilizing a conventional cement slurry.

While the heretofore utilized procedures described above have often been used successfully, they are relatively time consuming and expensive to carry out. Consequently, there is a continuing need for improved more economical subterranean zone sealing methods and compositions which can be utilized in subterranean zones to terminate lost circulation, undesirable fluid production, cross-flow zones or the like.

SUMMARY OF THE INVENTION

Improved methods and compositions for sealing subterranean zones penetrated by well bores are provided which meet the above described needs and overcome the deficiencies of the prior art. The methods of this invention for sealing subterranean zones are basically comprised of the steps of preparing a sealing composition comprised of an aqueous silicate solution, an epoxide containing liquid and a delayed epoxide hardening agent, placing the sealing composition into the subterranean zone by way of the well bore and then allowing the aqueous silicate solution to react with a silicate solution activator material and the epoxide containing liquid to react with the delayed hardening agent whereby the sealing composition sets into a rigid impermeable sealing mass in the zone.

The silicate solution activator material can be brine in the zone which contains alkaline-earth metal ions that upon contact with the aqueous silicate solution causes it to set into a stiff gel. Alternatively, a delayed silicate solution activator comprised of an ester or a temporarily coated acid can be included in the sealing composition.

The epoxide containing liquid in the sealing composition delayedly reacts with the epoxide hardening agent therein which causes the epoxide to set at substantially the same time as the aqueous silicate solution sets whereby a rigid impermeable sealing mass is produced which seals the zone and shuts off fluid flow into or out of the zone.

A sealing composition of the present invention is comprised of an aqueous silicate solution which reacts with a silicate solution activator material to form a sealing mass present in an amount in the range of from about 70% to about 90% by weight of the composition, an epoxide containing liquid present in an amount in the range of from about 8% to about 20% by weight of the composition and a delayed epoxide hardening agent present in an amount in the range of from about 2% to about 10% by weight of the composition. As mentioned above, the aqueous sodium silicate solution in the composition can be activated by brine in the zone to be sealed or it can include a delayed silicate solution activator such as an ester or a temporarily coated acid.

The sealing compositions of this invention are simple to prepare, low in cost and have long service lives at high temperatures. The methods of the invention are simple to carry out since the sealing compositions can be made to remain pumpable for desired periods of time before setting into rigid masses. In addition to being impermeable, the sealing masses have considerable compressive strength due to the presence of hardened epoxide therein. Thus, when a sealing mass of this invention is placed in a permeable zone penetrated by a well bore, it seals the zone and also increases the strength of the formation making up the zone.

It is, therefore, a general object of the present invention to provide improved methods and compositions for sealing subterranean zones.

Other and further objects, features and advantages of the present invention will be readily apparent to those skilled in the art upon a reading of the description of preferred embodiments which follows.

DESCRIPTION OF PREFERRED EMBODIMENTS

As mentioned above, drilling fluid circulation is often lost which requires the termination of drilling and the implementation of remedial procedures which are often of long duration and high cost. The remedial procedures have heretofore involved the placement of hardenable compositions such as aqueous cement compositions, cross-linked stiff gels and the like in the loss circulation zone. However, successful plugging of the zone often does not take place due to the dilution and washing away of the sealing compositions. In addition to drilling fluid lost circulation zones, zones containing pressurized fluids can be encountered which cause undesirable gas, oil or water production into the well bore and/or cross-flows through the well bore. When a heretofore utilized sodium silicate solution is used to temporarily plug such a lost circulation zone, producing zone or cross-flow zone, the ultimate sealing of the zone still must be accomplished with a cement composition or the like.

The present invention provides improved methods and compositions for sealing a subterranean zone penetrated by a well bore and terminating the loss of drilling fluids, completion fluids and other similar fluids from the well bore, terminating the undesirable production of fluids into the well bore and terminating cross-flows of fluids through the well bore. The methods of this invention for sealing a subterranean zone basically comprise the steps of preparing a set delayed sealing composition of this invention, placing the sealing composition in a subterranean zone to be sealed and allowing the sealing composition to set into a rigid impermeable sealing mass therein.

The sealing compositions of this invention are basically comprised of an aqueous silicate solution, an epoxide containing liquid and a delayed epoxide hardening agent. After the sealing composition is placed in a subterranean zone to be sealed, the aqueous silicate solution reacts with an activator material and the epoxide containing liquid reacts with the epoxide hardening agent whereby the sealing composition sets into a rigid impermeable sealing mass having substantial compressive strength.

The silicate solution activator material can be brine containing alkaline-earth metal ions which is naturally in the zone or brine which is placed in the zone as a preflush or afterflush. Alternatively, the silicate solution activator can be a delayed alkaline-earth metal solid or a delayed acid producing material such as an ester or an acid having a temporary coating thereon as will be described hereinbelow. In applications where a relatively large void in a subterranean zone must be sealed, the sealing composition can contain a suspended extending agent or bridging agent. Examples of such agents include, but are not limited to, sand, walnut hulls, gilsonite and any of various fibers.

A variety of alkali metal silicates can be utilized in accordance with the present invention. For example, sodium silicate, potassium silicate, lithium silicate, rubidium silicate and cesium silicate can all be used. Of these, sodium silicate is preferred, and of the many forms in which sodium silicate exists, those having an $Na_2O$ to $SiO_2$ weight ratio in the range of from about 1:2 to about 2:4 are most preferred. A particularly preferred commercially available aqueous sodium silicate solution for use in accordance with this invention is an aqueous sodium silicate solution having a density of about 11.67 pounds per gallon and a $Na_2O$ to $SiO_2$ weight ratio of about 1:3.22. This aqueous sodium silicate solution is commercially available from various vendors as Grade 40 sodium silicate and contains about 9.1% $Na_2O$, 29.2% $SiO_2$ and 61.7% water, all by weight of the solution. The aqueous silicate solution utilized is included in a sealing composition of this invention in an amount in the range of from about 70% to about 90% by weight of the composition.

Various delayed activators which react with the aqueous silicate solution and cause it to set into a gelled mass can be utilized. For example, if the subterranean zone to be sealed contains brine having alkaline-earth metal ions therein, the sealing composition of this invention which does not include a silicate solution activator component can be utilized. When the sealing composition reaches the zone to be sealed and contacts the brine therein, it reacts with alkaline-earth metal ions from the brine and immediately sets. The brine can be in the zone naturally or it can be injected into the zone before or after the sealing composition. If the zone does not contain brine, but the required time delay between when the sealing composition is prepared and when it sets is very short, an alkaline-earth metal solid which slowly dissolves and releases alkaline-earth metal ion, e.g., calcium or magnesium chloride, can be included in the sealing composition.

If the required time delay is moderate, any of the various esters which slowly undergo hydrolysis in the presence of water and form acids can be used as a component of the sealing composition. Examples of suitable such esters are triethyl citrate, ethyl acetate and ethyl glutamate.

When a longer time delay is required such as when the sealing composition is being pumped into a deep well bore, a solid acid in powdered form having a temporary coating thereon which degenerates with time or temperature or both can be used. Examples of particularly suitable such acids are citric acid, tartaric acid and gluconic acid. The acids can be coated with various temporary materials such as elastomers, petroleum waxes or one of the coating materials described in U.S. Pat. No. 4,741,401 issued to Walles, et al. on May 3, 1988 and U.S. Pat. No. 5,373,901 issued to Norman, et al. on Dec. 20, 1994, both of which are incorporated herein by reference. Elastomers such as ethylene-propylene terpolymer (EPDM) when coated on acid such as citric acid delay the reaction of the acid with the aqueous silicate solution for a time period in the range of from about three hours to about six hours at temperatures as high as about 350° F. Petroleum waxes which melt at different temperatures can be utilized in the same manner. For example, tartaric acid coated with a petroleum wax which melts at about 300° F. can be utilized to delay the reaction of the acid in a well having a bottom hole temperature of about 250° F. for a time period in the range of from about three hours to about six hours.

Generally, the delayed acid or alkaline-earth metal solid activator used is present in the sealing composition in an amount in the range of from about 1% to about 5% by weight of the aqueous silicate solution therein.

The compositions of this invention must often have low viscosities whereby they readily flow into the pores of permeable subterranean zones. Generally, the sealing compositions have a selected viscosity in the range of from about 10 to about 90 centimeters. To produce such relatively low viscosities, epoxide containing liquids are utilized in the sealing compositions. Preferred such epoxide containing liquids are selected from the group of diglycidyl ethers of 1,4-butanediol, neopentylglycol and cyclohexane dimethanol. A suitable epoxide containing liquid comprised of the diglycidyl ether of 1,4-butanediol is commercially available from the Shell Chemical Company of Houston, Tex. under the tradename "HELOXY®67. " This epoxide containing liquid has a viscosity at 25° C. in the range of from about 13 to about 18 centipoises, a molecular weight of 202 and a one gram equivalent of epoxide per about 120 to about 130 grams of the liquid. A suitable diglycidyl ether of neopentyl glycol is commercially available from Shell Chemical Company under the tradename "HELOXY®68. " This epoxide containing liquid has a viscosity at 25° C. in the range of from about 13 to about 18 centipoises, a molecular weight of 216 and a one gram equivalent of epoxide per about 130 to about 140 grams of the liquid. A suitable diglycidyl ether of cyclohexane dimethanol is commercially available from Shell Chemical Company under the tradename "HELOXY®107. " This epoxide containing liquid has a viscosity at 25° C. in the range of from about 55 to about 75 centipoises, a molecular weight of 256 and a one gram equivalent of epoxide per about 155 to about 165 grams of the liquid. The epoxide containing liquid utilized is generally included in the polymeric epoxide composition in an amount in the range of from about 8% to about 20% by weight of the composition.

A variety of hardening agents, including, but not limited to, aliphatic amines, aliphatic tertiary amines, aromatic amines, cycloaliphatic amines, heterocyclic amines, amido amine, polyamides, polyethyl amines and carboxylic acid anhydrides can be utilized with the above described epoxide containing liquids. Of these, aliphatic amines, aromatic amines and carboxylic acid anhydrides are the most suitable.

Examples of aliphatic and aromatic amine hardening agents are triethylenetetraamine, ethylenediamine, N-cocoalkyltrimethylenediamine, isophoronediamine, N-aminoethylpiperazines, imidazoline, 1, 2-diaminecyclohexane, diethyltoluenediamine and tris (dimethylaminomethylphenol). Examples of carboxylic acid anhydride hardening agents are methyltetrahydrophthalic anhydride, hexahydrophthalic anhydride, maleic anhydride, polyazelaic polyanhydride and phthalic anhydride. Of these, triethylenetetraamine, ethylenediamine, N-cocoalkyltrimethylenediamine, isophoronediamine, diethyltoluenediamine and dimethylaminomethylphenol are preferred, with isophoronediamine, diethyltoluenediamine and tris (diphenol) beomethylphenol) being the most preferred.

One or more of the above hardening agents can be utilized in the sealing compositions of this invention. The hardening agent or mixture of hardening agents is generally included in the compositions in an amount in the range of from about 2% to about 10% by weight of the compositions.

A preferred sealing composition of this invention is comprised of a Grade 40 aqueous sodium silicate solution present in an amount in the range of from about 70% to about 90% by weight of the composition, more preferably in an amount in the range of from about 75% to about 85% and most preferably about 80%; a delayed sodium silicate activator comprised of a triethylcitrate ester or an acid selected from the group of citric acid and tartaric acid having a temporary coating thereon which degenerates with time or temperature or both present in an amount in the range of from about 1% to about 5% by weight of the composition, more preferably in an amount of about 5%; an epoxide containing liquid selected from the group of the diglycidyl ether of 1,4-butanediol, the diglycidyl ether of neopentylglycol and the diglycidyl ether of cyclohexanedimethanol present in an amount in the range of from about 8% to about 20% by weight of the composition, more preferably in an amount of about 10%; and a delayed epoxide hardening agent comprised of a 2:10 by weight mixture of isophronediamine and diethyltoluenediamine present in an amount in the range of from about 2% to about 10% by weight of the composition, more preferably in an amount of about 5%.

In preparing the sealing compositions of this invention, the aqueous silicate solution used is placed in a mixer and the epoxide containing liquid is combined therewith. A delayed silicate solution activator, if used, is next combined with the mixture followed by a delayed epoxide hardening agent. After sufficient mixing, the resulting sealing composition is pumped into a subterranean zone where the sealing composition is to be placed and allowed to set therein.

The methods of the present invention for sealing a subterranean zone basically comprise the steps of preparing a set delayed sealing composition of this invention, placing the sealing composition in a subterranean zone to be sealed and allowing the sealing composition to set into a rigid sealing mass therein. The sealing mass formed is essentially impermeable and rigid while remaining resilient whereby it does not crack, shatter or readily otherwise fail upon impact, shock or formation movement. Also, the sealing mass adds compressive strength to the sealed subterranean formation.

In order to further illustrate the compositions and methods of this invention, the following examples are given.

EXAMPLE 1

Core plugs having dimensions of 1.75 inches in diameter and 2 inches in length were saturated with a 5% aqueous potassium chloride solution in a vacuum oven for 24 hours. A saturated core plug was then placed in a Baroid fluid loss cell equipped with a rubber core plug holder. A space above the core at the top of the cell was filled with 5% aqueous potassium chloride solution. The cell was closed and a pressure in the range of from 1 to 15 psi was exerted on the cell. Once the flow rate of 5% aqueous potassium chloride solution through the core was established, a measured volume of effluent was collected in a measured time. The water permeability of the plug was then calculated using the following equation.

$$K(md) = \frac{QML}{A\Delta P} \times 1{,}000$$

wherein:

$$K = \text{permeability of plug}$$

$$md = \text{millidarcies}$$

$$QM = \frac{\text{measured volume (ml)}}{\text{measured time (min.)}}$$

$$L = \text{length of plug}$$

$$A = \text{cross-sectional area of core}$$

$$\Delta P = \frac{\text{exerted pressure (psi)}}{14.7}$$

Once the water permeability of the core plug was calculated, the compressive strength of the core plug was then obtained by crushing the core in accordance with the procedure set forth in *API Specification For Materials and Testing For Well Cements*, API Specification 10, 5th ed., Jul. 1, 1990.

A second saturated core plug with the same permeability was then placed in the fluid loss cell holder and the space above the core plug was filled with a Grade 40 sodium silicate treatment fluid, the cell was closed and a pressure in the range of from 1 to 15 psi was exerted on the cell until the core sample was saturated with the sodium silicate treatment fluid. A 10% calcium chloride activator solution was then placed in the space above the core and using the same pressure, the calcium chloride solution was forced into the core plug. When the effluent exiting the core was found to be a stiff, jelly like mass, the core plug was removed from the fluid loss cell and cured at 120° F. for 24 hours under pressure. The permeability of the core plug was then measured using the technique set forth above and the compressive strength of the core was measured by crushing as described above.

A third saturated core plug with the same permeability was placed in the fluid loss cell and treated with Grade 40 sodium silicate and calcium chloride as described above in connection with the second core plug. The treated third core plug was then cured for 24 hours at 120° F. The core plug was again placed in the fluid loss cell and a blend of epoxide containing liquid (diglycidyl ether of cyclohexanedimethanol) and a hardening agent comprised of a 2:10 by weight mixture of isophronediamine and diethyltoluenediamine was forced through the cell by exerting a pressure in the range of from 1 to 15 psi thereon until a quantity of the epoxide containing liquid-hardening agent blend was collected as effluent. The epoxide containing liquid-hardening agent blend was comprised of 10% by weight epoxide containing liquid and 20% by weight hardening agent mixture. The core plug was then cured for 24 hours at 120° F. after which the water permeability and compressive strength were measured as described above. The above described tests were performed three times, the first time using Bera Sandstone cores and the second and third times using synthetic cores supplied by the Ferro Corp. of East Rochester, N.Y. The results of the tests are set forth in the Table below.

TABLE

PERMEABILITY AND COMPRESSIVE STRENGTH TESTS

| Test No. | Core Plug Material | Treatment Fluid Used | Permeability, md | Compressive Strength, psi |
|---|---|---|---|---|
| 1 | Berea Sandstone | None | 4045 | 556 |
| | Berea Sandstone | Grade 40 Sodium Silicate and 10% $CaCl_2$ Solutions | 46 | 712 |
| | Berea Sandstone | Grade 40 Sodium Silicate, 10% $CaCl_2$ Solution, Epoxide Containing liquid and Epoxide Hardening Agent | 0.97 | 988 |
| 2 | Synthetic Core | None | 6091 | 11,637 |
| | Synthetic Core | Grade 40 Sodium Silicate and 10% $CaCl_2$ Solution | 30 | 10,390 |
| | Synthetic Core | Grade 40 Sodium Silicate, 10% $CaCl_2$ Solution, Epoxide Containing Liquid and Epoxide Hardening Agent | 0.009 | 14,170 |
| 3 | Synthetic Core | None | 5376 | — |
| | Synthetic Core | Grade 40 Sodium Silicate and 10% $CaCl_2$ Solution | 55 | — |
| | Synthetic Core | Grade 40 Sodium Silicate, 10% $CaCl_2$ Solution, Epoxide Containing Liquid and Epoxide Hardening Agent | 0 | — |

From the test results set forth in the Table, it can be seen that the composition of the present invention comprised of an aqueous sodium silicate solution, an aqueous 10% calcium chloride activator solution, an epoxide containing liquid and an epoxide hardening agent substantially increased the compressive strengths of the core plugs and reduced the permeabilities of the core plugs to very low levels, i.e., little or no permeability.

Thus, the present invention is well adapted to carry out the objects and attain the benefits and advantages mentioned as well as those which are inherent therein. While numerous changes to the compositions and methods can be made by those skilled in the art, such changes are encompassed within the spirit of this invention as defined by the appended claims.

What is claimed is:

1. A method of sealing a subterranean zone penetrated by a well bore comprising the steps of:

(a) preparing a sealing composition comprised of an aqueous silicate solution, an epoxide containing liquid and a delayed epoxide hardening agent;

(b) placing said sealing composition into said subterranean zone by way of said well bore; and (c) allowing said aqueous silicate solution to react with a silicate solution activator material and said epoxide containing liquid to react with said epoxide hardening agent whereby said sealing composition sets into a rigid impermeable sealing mass in said zone.

2. The method of claim 1 wherein said aqueous silicate solution is an aqueous alkali metal silicate solution present in said sealing composition in an amount in the range of from about 70% to about 90% by weight of said composition.

3. The method of claim 2 wherein said aqueous alkali metal silicate solution is a Grade 40 sodium silicate solution.

4. The method of claim 1 wherein said silicate solution activator is comprised of alkaline-earth metal ions.

5. The method of claim 1 wherein said sealing composition further includes a delayed silicate solution activator comprised of an ester selected from the group of triethyl citrate, ethyl acetate and ethyl glutamate present in an amount in the range of from about 1% to about 5% by weight of said composition.

6. The method of claim 1 wherein said sealing composition further includes a delayed silicate solution activator comprised of an acid selected from the group of citric acid, tartaric acid and gluconic acid having a temporary coating thereon which degenerates with time or temperature or both present in an amount in the range of from about 1% to about 5% by weight of said composition.

7. The method of claim 6 wherein said coating is selected from the group of elastomers and waxes.

8. The method of claim 1 wherein said epoxide containing liquid is selected from the group of the diglycidyl ether of 1,4-butanediol, the diglycidyl ether of neopentyl glycol and the diglycidyl ether of cyclohexane dimethanol and is present in said sealing composition in an amount in the range of from about 8% to about 20% by weight of said composition.

9. The method of claim 1 wherein said delayed epoxide hardening agent is at least one member selected from the group of aliphatic amines, aromatic amines and carboxylic acid anhydrides and is present in said sealing composition in an amount in the range of from about 2% to about 10% by weight of said composition.

10. The method of claim 1 wherein said delayed epoxide hardening agent is selected from the group of triethylenetetraamine, ethylenediamine, N-cocoalkyltrimethylenediamine, isophoronediamine, diethyltoluenediamine, and tris(dimethylaminomethylphenol) and is present in said sealing composition in an amount in the range of from about 2% to about 10% by weight of said composition.

11. A subterranean zone sealing composition comprising:

an aqueous silicate solution which reacts with a silicate solution activator material to form a gel present in an amount in the range of from about 70% to about 90% by weight of said composition;

an epoxide containing liquid present in an amount in the range of from about 8% to about 20% by weight of said composition; and a delayed epoxide hardening agent present in an amount in the range of from about 2% to about 10% by weight of said composition.

12. The composition of claim 11 wherein said aqueous silicate solution is an aqueous alkali metal silicate solution present in said sealing composition in an amount in the range of from about 75% to about 85% by weight of said composition.

13. The composition of claim 12 wherein said aqueous alkali metal silicate solution is a Grade 40 sodium silicate solution.

14. The composition of claim 11 which further includes a delayed silicate solution activator comprised of an alkaline-earth metal salt which releases alkaline-earth metal ion present in an amount in the range of from about 1% to about 5% by weight of said composition.

15. The composition of claim 11 which further comprises a delayed silicate solution activator comprised of an ester selected from the group of triethyl citrate, ethyl acetate and ethyl glutamate present in an amount in the range of from about 1% to about 5% by weight of said composition.

16. The composition of claim 11 which further includes a delayed silicate solution activator comprised of an acid selected from the group of citric acid, tartaric acid and gluconic acid having a temporary coating thereon which degenerates with time or temperature or both present in an amount in the range of from about 1% to about 5% by weight of said composition.

17. The composition of claim 16 wherein said coating is selected from the group of elastomers and waxes.

18. The composition of claim 11 wherein said epoxide containing liquid is selected from the group of the diglycidyl ether of 1,4-butanediol, the diglycidyl ether of neopentyl glycol and the diglycidyl ether of cyclohexane dimethanol and is present in said sealing composition in an amount in the range of from about 8% to about 20% by weight of said composition.

19. The composition of claim 11 wherein said delayed epoxide hardening agent is at least one member selected from the group of aliphatic amines, aromatic amines and carboxylic acid anhydrides and is present in said sealing composition in an amount in the range of from about 2% to about 10% by weight of said composition.

20. The composition of claim 11 wherein said delayed epoxide hardening agent is selected from the group of triethylenetetraamine, ethylenediamine, N-cocoalkyl-trimethylenediamine, isophoronediamine, diethyltoluenediamine, and tris(dimethylaminomethylphenol) and is present in said sealing composition in an amount in the range of from about 2% to about 10% by weight of said composition.

* * * * *